US005470299A

United States Patent [19]

Yeh

[11] Patent Number: 5,470,299

[45] Date of Patent: Nov. 28, 1995

[54] ADJUSTABLE BENCH DEVICE FOR EXERCISERS

[76] Inventor: Jonathan Yeh, No. 77-3, Nanshih Village, Linkou Hsiang, Taipei Hsien, Taiwan

[21] Appl. No.: 228,961

[22] Filed: Apr. 18, 1994

[51] Int. Cl.[6] ..... A63B 21/00

[52] U.S. Cl. ..... 482/142; 482/112; 482/137

[58] Field of Search ..... 482/104, 130, 482/133, 142, 908; 207/317, 321, 322, 342, 343; 5/17, 18.1, 57.1, 42, 42.1

[56] References Cited

U.S. PATENT DOCUMENTS

| | | | |
|---|---|---|---|
| 4,204,288 | 5/1980 | Villa et al. | 5/18.1 X |
| 4,861,025 | 8/1989 | Rockwell | 482/104 |
| 5,018,727 | 5/1991 | Cornell | 462/142 |

*Primary Examiner*—Richard J. Apley

*Assistant Examiner*—John Mulcany

*Attorney, Agent, or Firm*—William E. Pelton

[57] ABSTRACT

An exerciser includes first and second base sections which are adjustable with each other along a longitudinal direction thereof, a frame extending upwardly from the first base section, and a bench device. A disc is pivotally mounted to the frame. A handle is pivotably mounted to the disc to pivot therewith for operating a resistance device and is retained in a desired angular position relative to disc. The bench device includes a substantially L-shaped first member having a first end pivotally mounted to the second base section and a second end, a second member having an end pivotally connected to the second end of the L-shaped first member and having an element mounted to a mediate section thereof, and a substantially L-shaped third member having a first end pivotally connected to the frame and a second end pivotally mounted to the element of the second member. By such an arrangement, the bench device may be adjusted to any desired status.

2 Claims, 6 Drawing Sheets

ADJUSTABLE BENCH DEVICE FOR EXERCISERS

BACKGROUND OF THE INVENTION

1. Field of the Invention

The present invention relates to an adjustable bench device for exercisers.

2. Description of Related Art

Exercisers are important to modern people having less time and space to exercise. Although a wide variety of exercisers have heretofore been provided, the bench thereof is not adjustable and thus limits the function.

Therefore, there has been a long and unfulfilled need for an adjustable bench for exercisers to meet this end.

SUMMARY OF THE INVENTION

The present invention provides an exerciser which includes first and second base sections which are adjustable with each other along a longitudinal direction thereof, a frame extending upwardly from the first base section, and a bench device. A disc is pivotally mounted to the frame. A handle is mounted to the disc to pivot therewith for operating a resistance device and is pivotably retained in a desired angular position relative to the disc. The bench device includes a substantially L-shaped first member having a first end pivotally mounted to the second base section and a second end, a second member having an end pivotally connected to the second end of the L-shaped first member and having an element mounted to a mediate section thereof, and a substantially L-shaped third member having a first end pivotally mounted to the frame and a second end pivotally connected to the element of the second member. By such an arrangement, the bench device may be adjusted to any desired status.

Preferably, the first base section is a substantially T-shaped member with a plurality of longitudinally spaced holes therein and the second base section is a substantially T-shaped second member with a pin thereon for releasably and selectively engaging with one of the holes.

Other objects, advantages, and novel features of the invention will become more apparent from the following detailed description when taken in conjunction with the accompanying drawings.

DESCRIPTION OF THE PREFERRED EMBODIMENT

Figure 1:
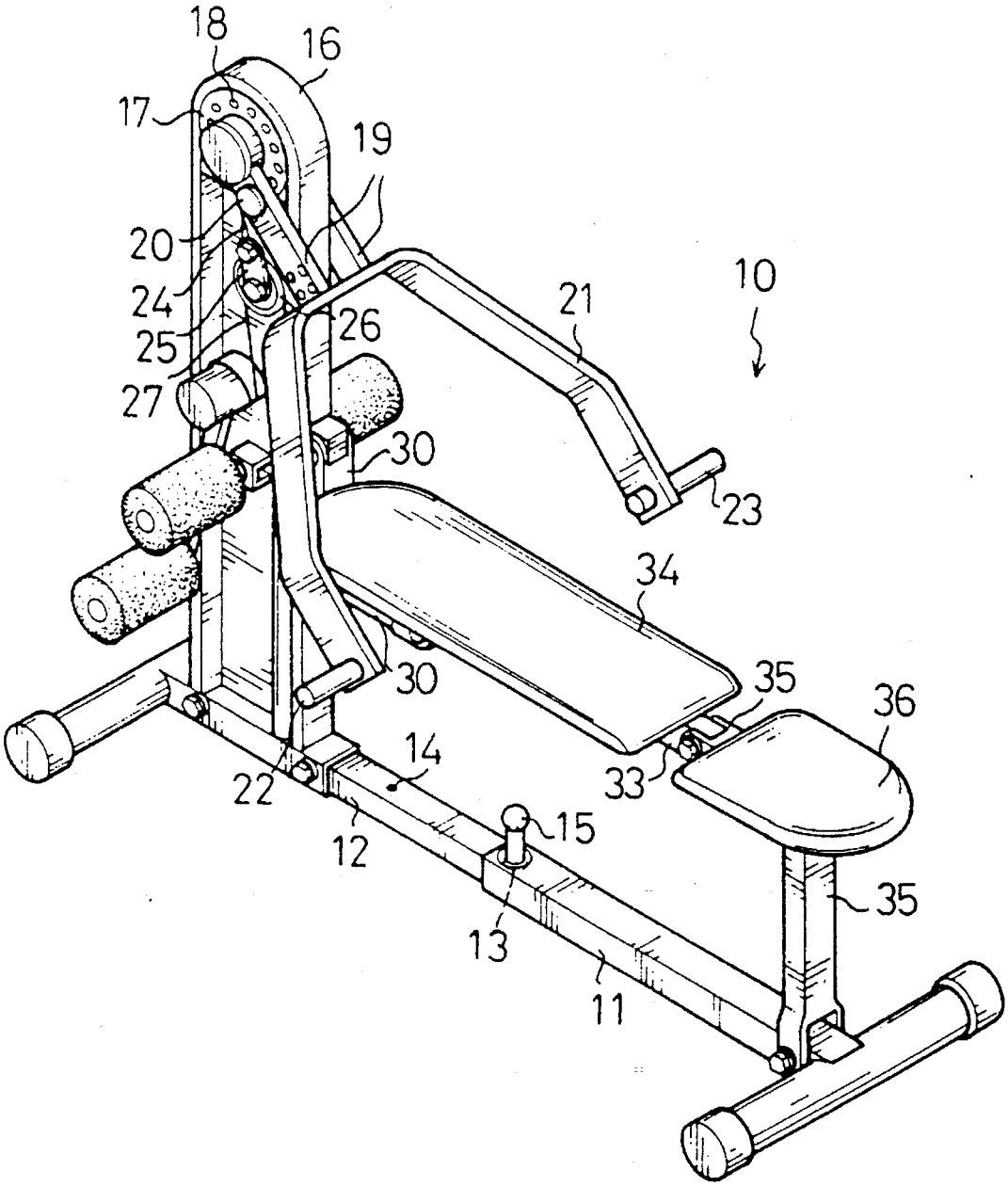
FIG. 1 is a perspective view of an exerciser with an adjustable bench device in accordance with the present invention.
Figure 2:
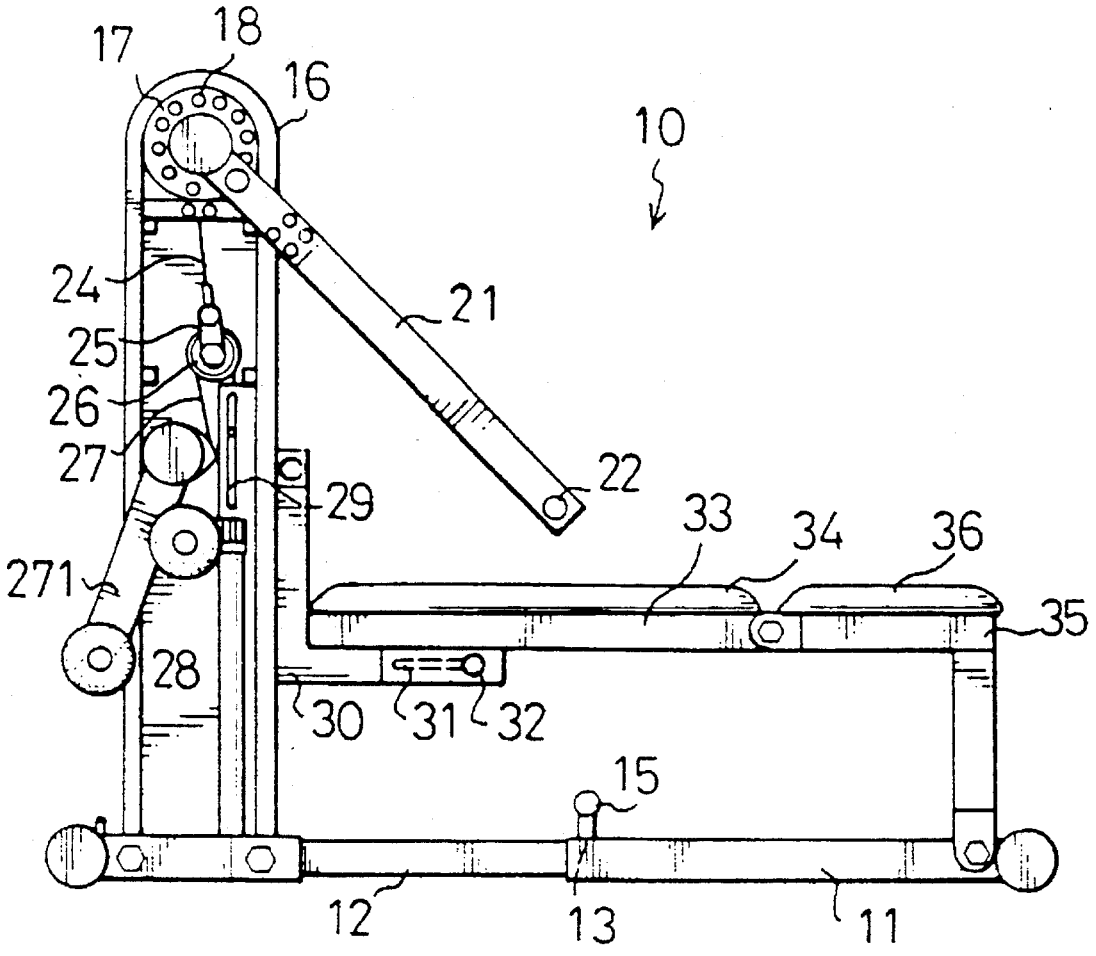
FIG. 2 is a side-elevational view of the exerciser in FIG. 1.

Referring to the drawings and initially to FIGS. 1 and 2, an exerciser in accordance with the present invention is designated by reference numeral "10" and generally includes a first base section, such as a T-shaped tube 11, and a second base section, such as a second T-shaped tube 12 which is adjustably coupled to tube 11. In this embodiment, tube 12 includes two spaced holes 13 and 14 in a distal end of a lengthwise section thereof, and a pin 15, preferably a spring-biased one, is mounted to tube 11 to selectively engage with one of the holes 13 and 14 in tube 12, operation of which will be described in detail hereinafter.

A frame 16 extends upwardly from the other end of tube 12 and has a disc 17 pivotally mounted to an upper end thereof, the disc 17 having a plurality of annularly spaced holes 18. A handle means 21 with two handgrips 22 and 23 thereon is pivotably connected to the frame 16 via two arms 19 to pivot therewith. A pin 20 is provided to selectively and releasably engage with one of the holes 18 to lock the handle means 21 in a desired angular position relative to the disc 17.

A steel loop 24 is mounted around the disc 17 and is attached to a fixing plate 25 and a pulley 26. A steel cable 27 passes around the pulley 26 and has a first end attached to a leg operative member 271 and a second end attached to a piston rod 29 of a vertical hydraulic cylinder 28 which acts as a resistance means for the exerciser, detailed structure of which is described in applicant's copending U.S. Pat. application Ser. No. 08/228,937, filed Apr. 18, 1994.

The exerciser further includes a bench device which includes a first mat 34 mounted on member 33 and a second mat 36 mounted on a substantially L-shaped member 35 whose first end is pivotally mounted tube 11 and a second end pivotally connected to a first end of member 33. A second L-shaped member 30 has a first limb (not labeled) whose distal end is pivotally mounted to the frame 16 and a second limb (not labeled) whose distal end is pivotally connected to an underside of member 33 via an element 32, the second limb having a longitudinal sliding slot 31 such that element 32 may slide therealong.

Figure 3:
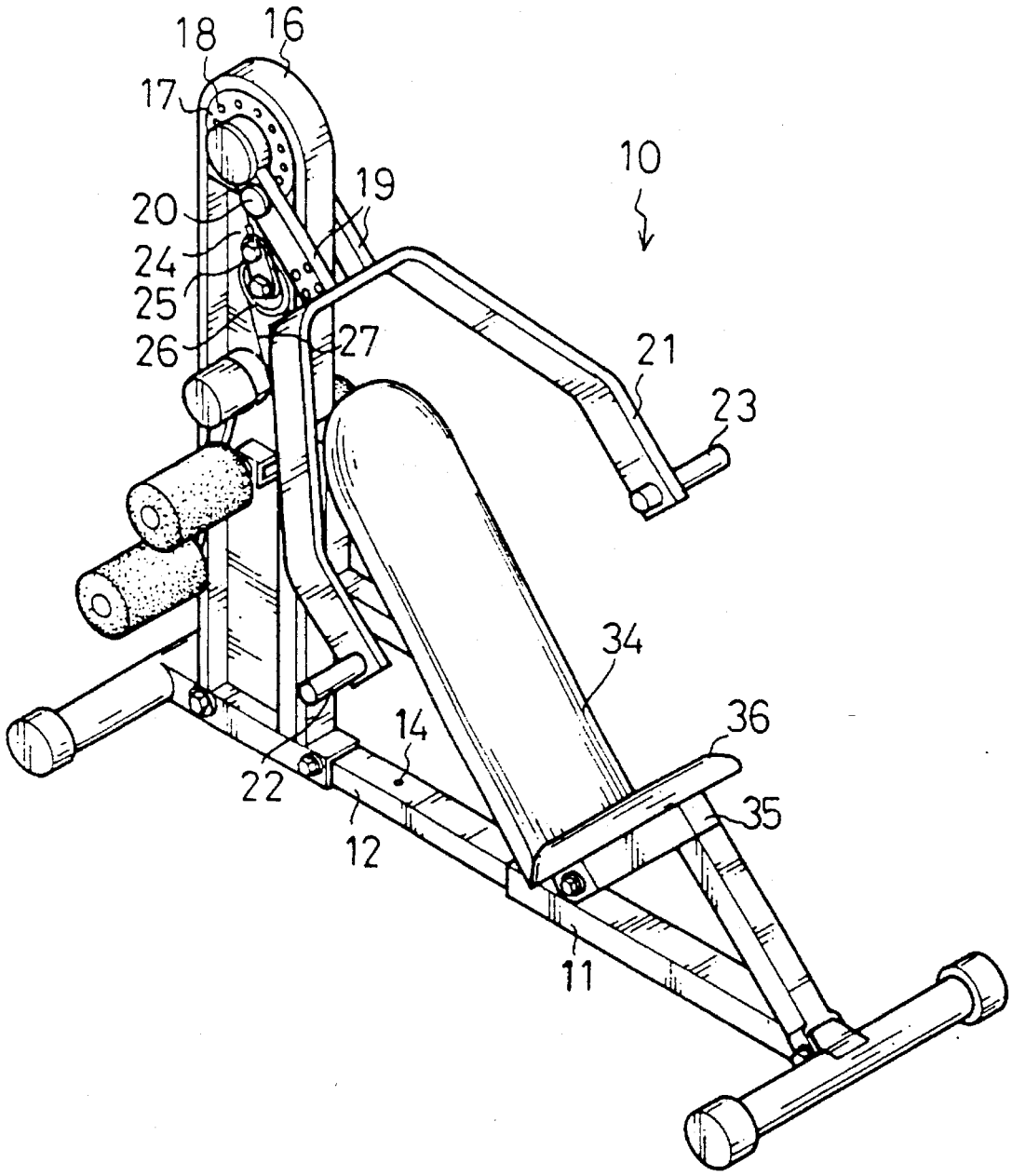
FIG. 3 is a perspective view of the exerciser in which the bench device is in another status.
Figure 4:
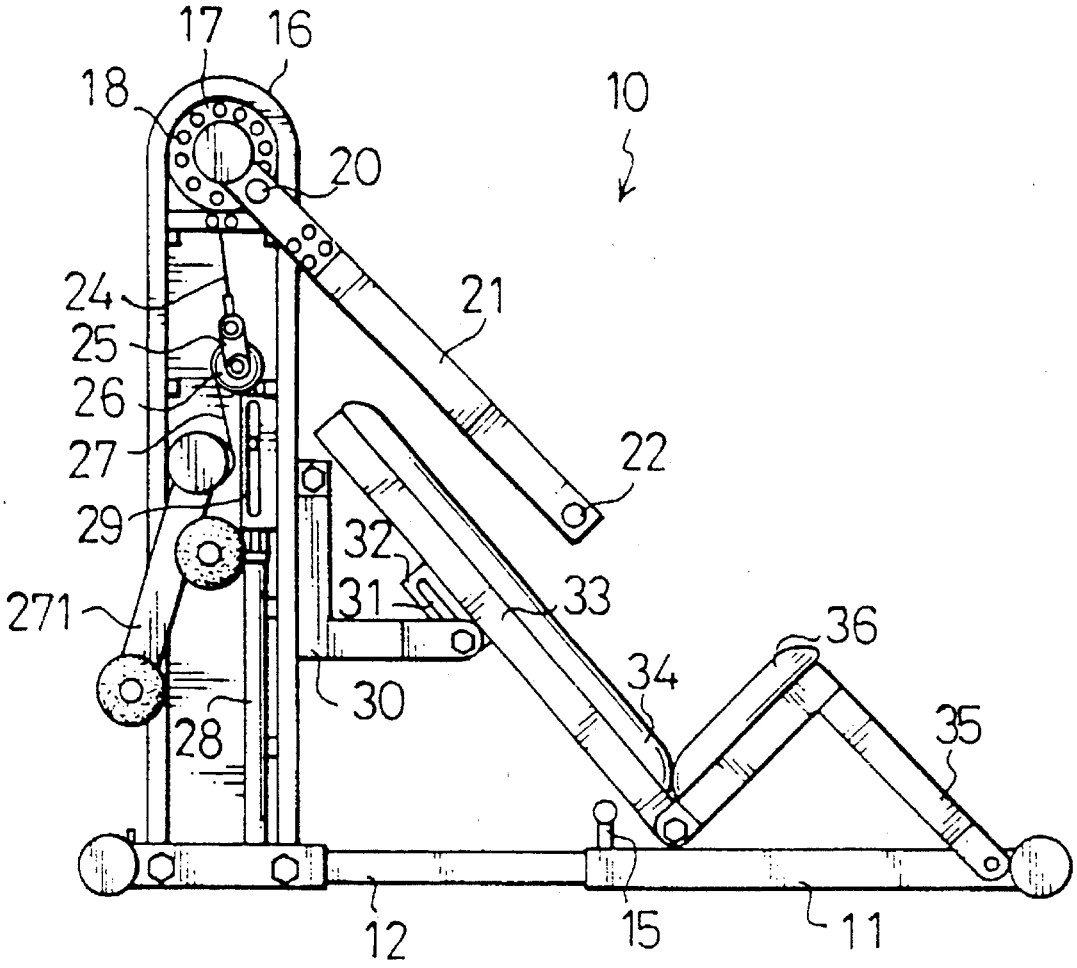
FIG. 4 is a side-elevational view of the exerciser in FIG. 3.
Figure 5:
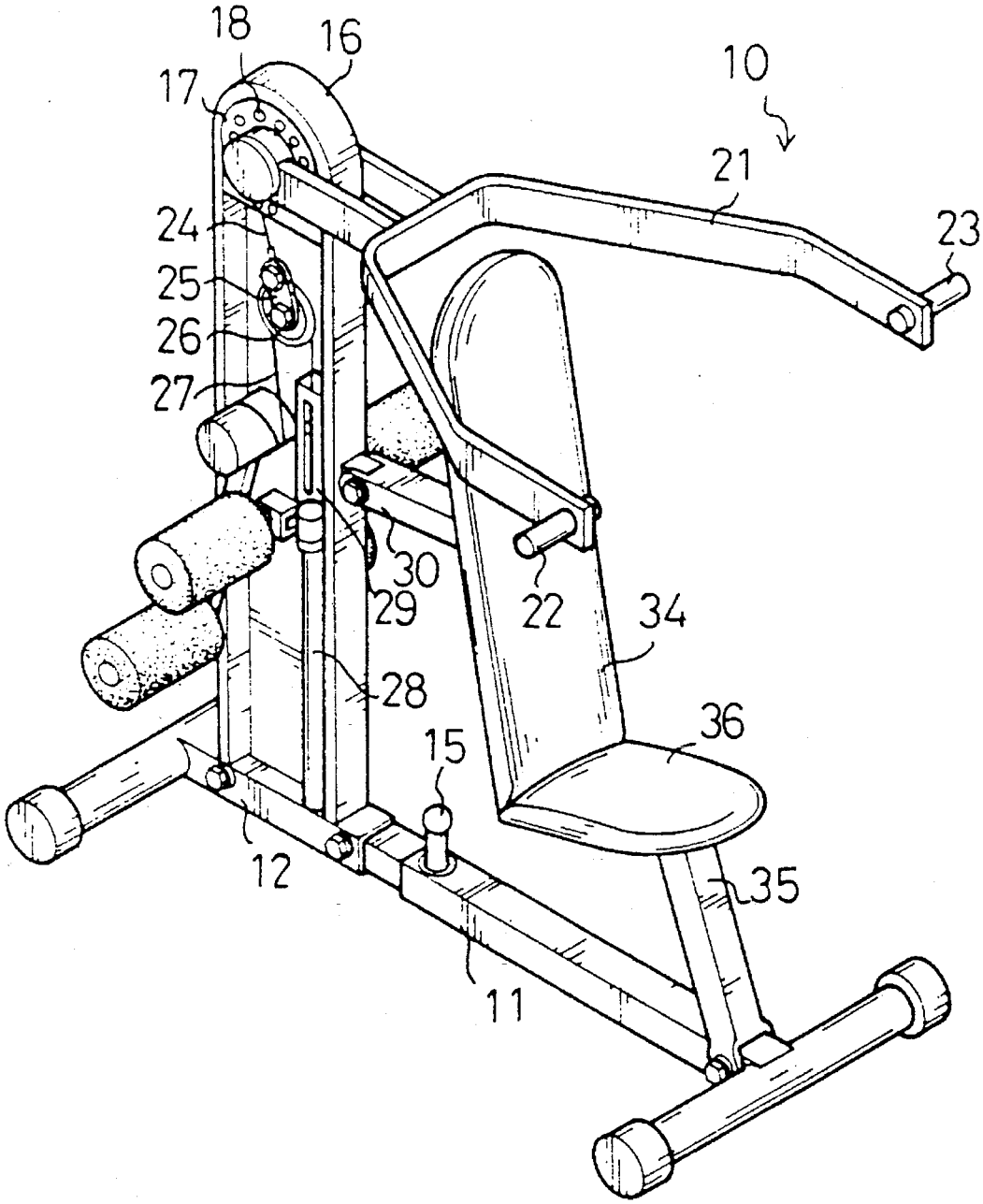
FIG. 5 is a perspective view of the exerciser in which the position of the bench device is further changed.
Figure 6:
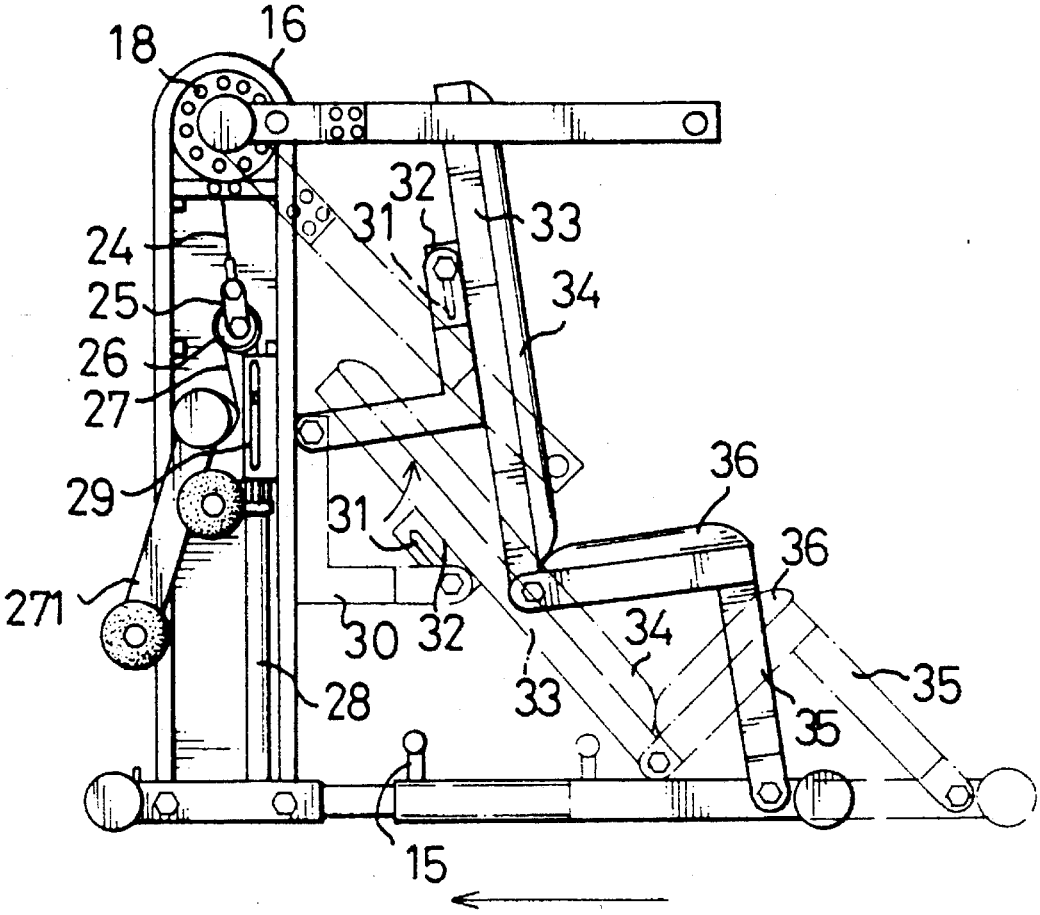
FIG. 6 is a side-elevational view of the exerciser in FIG. 5.

When the bench device is in a position shown in FIGS. 1 and 2, the user may lie flat on the first and second mats 34 and 36 to proceed with push up exercises on the handle means 21 and/or leg exercises on the leg operative member 271 which is beyond the field of the invention and therefore is not further described. Turning to FIGS. 3 and 4, members 33 and 35 are adjusted (by lowering the pivotal point therebetween) to a substantially perpendicular relationship such that the user may lie in an inclined manner to proceed with push up exercises with his/her hands. It is appreciated that the handle means 21 has been moved to a proper angular position relative to the disc 17 to suit the user. The user also may change the bench device from a status shown by phantom lines in FIG. 6 to another status shown by solid lines in FIGS. 5 and 6 by means of suitable pivotal movement of L-shaped member 30 and sliding movement of member 32 along slot 31. Again, the handle means 21 has been moved to a proper angular position relative to the disc 17 to suit the user, while pin 15 on tube 11 is released from hole 13 to engage with another hole 14 in tube 12 upon leftward movement of tube 11 relative to tube 12 (see the arrow in FIG. 6).

It is appreciated that tube 12 may have more than two holes such that the bench device may be adjusted to any desired status.

Although the invention has been explained in relation to its preferred embodiment, it is to be understood that many other possible modifications and variations can be made without departing from the spirit and scope of the invention as hereinafter claimed.

I claim:

1. An exerciser comprising:

first and second base sections having a longitudinal direction and being adjustable with each other along said longitudinal direction;

a frame extending upwardly from said first base section, a disc being pivotally mounted to said frame, a handle means being pivotably mounted to said disc to pivot therewith and a means for retaining said handle means in a desired angular position relative to said disc, and a resistance means operable by said handle means; and an adjustable bench device comprising:

a substantially L-shaped first member having a first end pivotally mounted to said second base section and a second end;

a first mat mounted to said first member;

a second member having an end pivotally connected to said second end of said L-shaped first member and having an element mounted to a mediate section thereof; and a second mat mounted to said second member;

a substantially L-shaped third member having a first end pivotally mounted to said frame and a second end pivotally connected to said element of said second member;

whereby the bench device may be adjusted to form a flat bench and a chair.

2. The exerciser as claimed in claim 1 wherein said first base section is a substantially T-shaped member with a plurality of longitudinally spaced holes therein and said second base section is a substantially T-shaped second member with a pin thereon for releasably and selectively engaging with one of said holes.

* * * * *